United States Patent [19]

Abrams

[11] Patent Number: 4,495,060

[45] Date of Patent: Jan. 22, 1985

[54] QUENCHING HYDROCARBON EFFLUENT FROM CATALYTIC REACTOR TO AVOID PRECIPITATION OF ASPHALTENE COMPOUNDS

[75] Inventor: Lawrence M. Abrams, Miami, Fla.

[73] Assignee: HRI, Inc., Gibbsboro, N.J.

[21] Appl. No.: 453,259

[22] Filed: Dec. 27, 1982

[51] Int. Cl.[3] ..... C10G 9/16; C10G 65/10

[52] U.S. Cl. ..... 208/48 Q; 208/59; 208/102

[58] Field of Search ..... 208/100, 102, 103, 105, 208/59, 48 R, 48 Q, 108

[56] References Cited

U.S. PATENT DOCUMENTS

| | | | |
|---|---|---|---|
| 2,989,459 | 6/1961 | Eastman et al. | 208/102 |
| 3,471,398 | 10/1969 | Borst, Jr. | 208/111 |
| 3,544,447 | 12/1970 | Van Driesen | 208/48 R |
| 3,645,887 | 2/1972 | Mounce | 208/96 |
| 3,841,981 | 10/1974 | Layng | 208/48 Q |

FOREIGN PATENT DOCUMENTS

| | | | |
|---|---|---|---|
| 873004 | 7/1961 | United Kingdom | 208/48 Q |

*Primary Examiner*—Delbert E. Gantz
*Assistant Examiner*—O. Chaudhuri
*Attorney, Agent, or Firm*—V. A. Mallare

[57] ABSTRACT

A process for high hydroconversion of petroleum residua containing at least about 25 V % material boiling above 1000° F. to produce lower boiling hydrocarbon liquid products and avoid undesirable precipitation of asphaltene compounds. In the process, the feedstock is at least about 50 percent catalytically hydroconverted to material boiling below 975° F. and containing a mixture of gas and liquid fractions, after which the gas fraction is removed and the resulting liquid fractions is pressure-reduced and quenched to a temperature below about 775° F. To avoid precipitation of asphaltene compounds which causes operational difficulties in the downstream equipment, the quench liquid used should have an API gravity not more than about 22° API higher than the API gravity of the first pressure-reduced liquid fraction. The resulting liquid fraction is distilled to produce hydrocarbon liquid products, and a residual bottoms fraction is usually recycled to the catalytic reaction step to obtain increased percent conversion to lower boiling liquid products.

12 Claims, 1 Drawing Figure

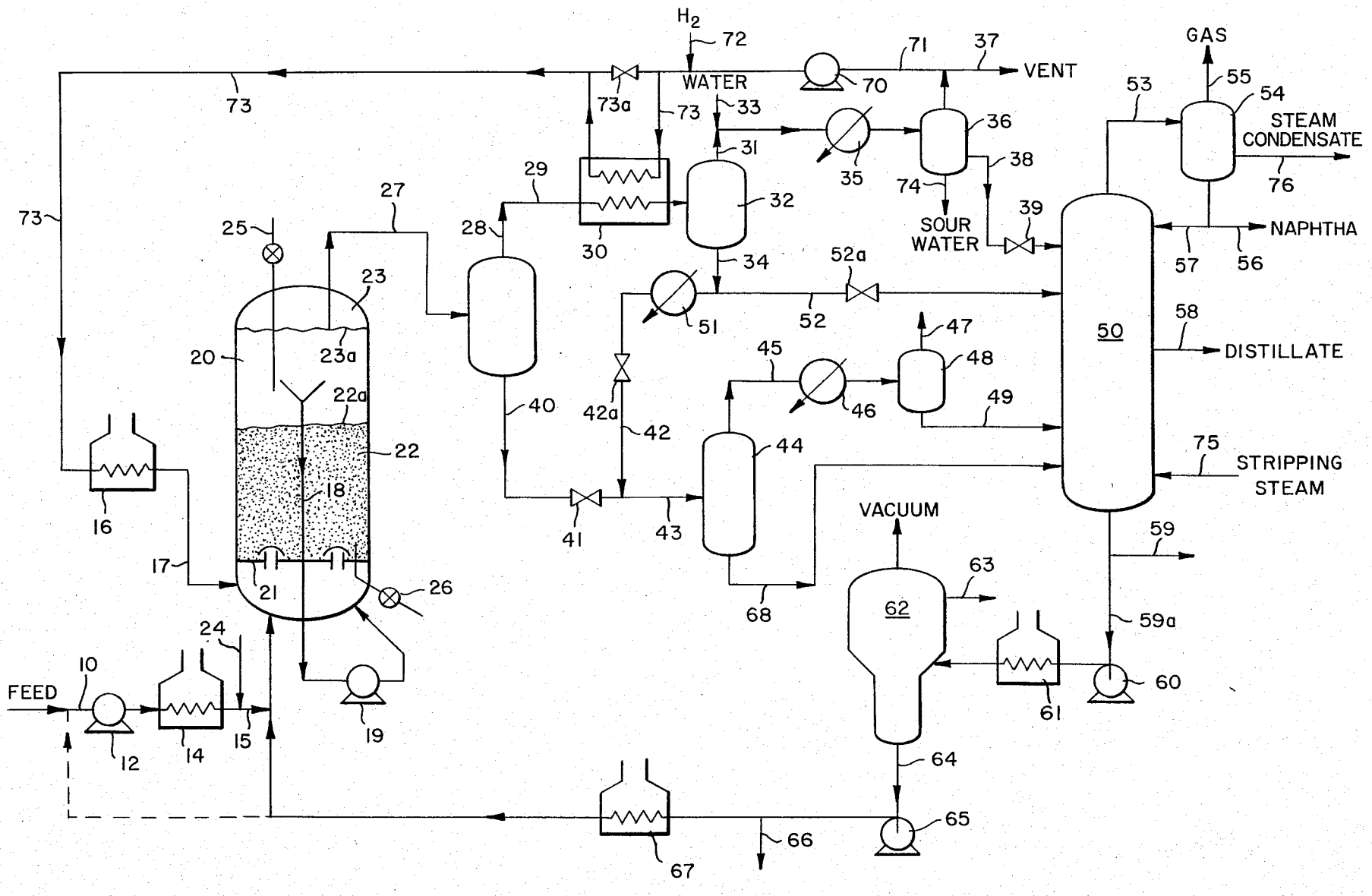
STEAM CONDENSATE
NAPHTHA
DISTILLATE
STRIPPING STEAM
GAS
VENT
SOUR WATER
VACUUM
WATER
$H_2$
FEED

QUENCHING HYDROCARBON EFFLUENT FROM CATALYTIC REACTOR TO AVOID PRECIPITATION OF ASPHALTENE COMPOUNDS

BACKGROUND OF INVENTION

This invention pertains to catalytic hydroconversion of petroleum residua feedstocks to produce lower boiling hydrocarbon liquid products. It pertains particularly to a catalytic hydroconversion process in which the reaction zone effluent is quenched to a temperature below about 775° F. using a specific hydrocarbon material fraction, so as to avoid precipitation of asphaltene compounds in downstream processing equipment and provide sustained high conversion operations.

When heavy oil feedstocks such as crude petroleum oil, atmospheric residuum, vacuum residuum, or tar sands bitumen are hydrogenated in an ebullated bed catalytic reactor, the operating temperature is usually maintained above about 750° F., with a typical reaction temperature being in the range of 800° F. to 850° F. When the reactor hot effluent stream is withdrawn from the reactor, the resulting liquid stream is normally quenched by direct injection of oil to cool the effluent stream to approximately 750° F., so as to stop the thermally instigated reactions which subsequently cause product degradation and/or coke formation. However, it has been found that such quenching of the hot hydrocarbon effluent material can often cause undesirable precipitation of asphaltene compounds in downstream processing equipment, which causes serious operational difficulties in the process.

The catalytic hydrogenation of petroleum residua in an ebullated-bed reactor is well known. For example, in U.S. Pat. No. Re. 25,770 to Johanson, a process is disclosed whereby an ebullated bed catalytic reactor is used to accomplish hydroconversion of hydrocarbon feed material boiling above 975° F. in an expanded catalyst bed, to produce lower boiling distillates, the catalyst particles being maintained in random motion by upward flow of the reactants. The recycle of hydrocarbon reactants boiling above about 680° F. to the reaction zone is disclosed in U.S. Pat. No. 3,412,010 to Alpert, et al, wherein the recycle of such heavy fractions permits operation at higher levels of conversion of the 975° F.+ material. Also, moderate conversion of petroleum residua feedstocks to remove asphaltenes prior to desulfurization is disclosed in U.S. Pat. No. 3,948,756 to Wolk et al.

It has been known that operations on petroleum residua feedstocks at high hydroconversion levels, i.e., above about 75 V %, are not sustainable when the depressurized vaporous and liquid effluents from the catalytic reactor are permitted to mix under conditions of cooling to below about 750° F. as is disclosed in U.S. Pat. No. 3,338,820 to Wolk et al. However, it has been observed that for conversions above about 85% this arrangement does not result in sustained operations. These high conversion reaction conditions cause precipitation of asphaltenes in a meso-phase which fouls and can even plug the downstream equipment, and when recycled to the reactor such asphaltenes cause the catalyst bed to agglomerate and defluidize. A long-sought solution to this asphaltene precipitation problem is advantageously provided by the present invention.

SUMMARY OF INVENTION

The invention provides a process for high hydroconversion of petroleum residua feed materials in which the reaction zone is operated under high conversion conditions, defined as operating conditions such that more than about 75 V % of the hydrocarbon material boiling above 1000° F. and present in the net reactor fresh feed stream is converted to material boiling at temperatures below 1000° F. It has been found that the quench oil stream used to quench and quickly cool the reactor hot effluent material must have an API gravity of the total liquid quench stream, including dissolved gases, not more than about 22° API higher than the API gravity of the total liquid stream including dissolved gases being quenched, and preferably is not more than about 17° API higher than such stream. Additionally, the $C_5$+ portion of the quench oil stream used, i.e. all fractions boiling above about 95° F., should have an API gravity not more than about 25° API higher than that of the $C_5$+ portion of the liquid stream being quenched, and preferably is not more than about 20° API higher, in order to prevent the formation of a separate incompatible liquid hydrocarbon phase in the quenched stream. Such separate liquid phase causes severe operating and fouling problems in downstream processing equipment such as heat exchangers separation vessels, and fractionation columns.

More specifically, the invention comprises a process for high conversion of petroleum residua feedstock material containing at least about 25 V % material boiling above 1000° F. to produce lower boiling hydrocarbon liquid products, comprising the steps of feeding a petroleum residua feedstock together with hydrogen into a reaction zone containing an ebullated catalyst bed, maintaining said reaction zone at 750°-900° F. temperature, and 1000-5000 psig hydrogen partial pressure for liquid phase reaction to produce a hydroconverted material containing a mixture of gas and liquid fractions; separating said gas fraction from said liquid fractions in a first separation zone to provide a first gas fraction and a first liquid fraction, and cooling said first gas fraction to below about 650° F. to condense the gas and form a gas-liquid mixture; further separating said cooled gas fraction from said mixture in a second phase separation zone to provide a second gas fraction and a second liquid fraction and cooling said second liquid fraction to below about 650° F.; pressure-reducing said first liquid fraction to a pressure below about 1000 psig and flashing vapor from the liquid fraction while mixing the resulting liquid with at least a portion of said cooled second liquid fraction to quench the liquid to a temperature below about 775° F., said cooled second liquid fraction having an API gravity not more than about 22° API higher than the API gravity of said first liquid fraction; and distilling said mixed liquid fractions to produce hydrocarbon distillate liquid products having normal boiling temperature below about 875° F. and a residual bottoms material. A portion of the residual bottoms material is advantageously recycled to the reaction zone to provide increased conversion to lower boiling hydrocarbon liquid products.

It is thus an advantage of this invention that by limiting the °API gravity difference for the quenching oil compared to that of the first liquid fraction, the precipitation of asphaltenes is avoided in the reactor and downstream equipment and sustained high conversion operations, i.e., above about 85 V % of 975° F.+ material, are achieved.

BRIEF DESCRIPTION OF DRAWINGS

FIG. 1 is a schematic flow diagram of a hydroconversion process for petroleum residua according to the present invention.

DESCRIPTION OF INVENTION

It has been unexpectedly found that satisfactory sustained hydroconversion operations on petroleum residua feedstocks at high hydroconversions levels are achieved in ebullated catalyst bed reactors only when provision is made to avoid use of low boiling hydrocarbon liquid streams for quenching and cooling the reactor effluent pressure-reduced liquid fractions in the downstream recovery zones. Specifically, it has been found that the quenching oil stream used should have an API gravity which is not more than about 22° API higher than the API gravity of the total liquid stream being quenched, and preferably is not more than about 17° API higher than for such quenched streams. In addition, the $C_5$+ portion of the quench liquid stream, i.e. fractions boiling above about 95° F., should not have an API gravity more than about 25° API higher than the API gravity of the $C_5$+ portion of the liquid stream being quenched, and should preferably not be more than about 20° API higher than for that stream. When these requirements for liquid quenching and rapid cooling are met, hydroconversion of the pertroleum residua feed in the range of about 80–98 V %, based on disappearance of 1000° F.+ material present in the fresh feed, is achieved in sustained ebullated bed reactor operations of indefinite duration.

The broad catalytic reaction conditions which can be used for this invention are 750°–900° F. temperature, 1000–5000 psig hydrogen partial pressure, and liquid space velocity of 0.1–2.5 $V_f/hr/V_r$. Catalyst replacement rate should usually be 0.1–2.0 pounds catalyst per barrel feed. The operating conditions of temperature, pressure, liquid space velocity, and catalyst replacement rate at which these high conversions are maintained are practical and economic, in that the cost per unit of material converted is not increased significantly if at all as conversion is increased to these increased levels from those conditions operable under lower conversion conditions. Without using this invention, the problems with fouling and plugging of process equipment described above are encountered at conversion levels in the range of 65–75 V %, and operations at desired high conversion levels of 80–98 V % cannot be sustained.

This invention is useful for petroleum feedstocks containing at least about 2 W % asphaltenes, or in which the 975° F.+ fraction contains at least about 5 W % Ramsbottom carbon residues (RCR). Such feedstocks include but are not limited to crudes, atmospheric bottoms and vacuum bottoms materials obtained from petroleum fields in Alaska, Athabasca, Bachaquero, Cold Lake, Lloydminster, Orinoco and Saudi Arabia.

As illustrated by FIG. 1, a heavy petroleum residua feedstock at 10, such as Arabian light or medium vacuum resid, is pressurize at 12 and passed through preheater 14 for heating to at least about 500° F. The heated feedstream at 15 is introduced into upflow ebullated bed catalytic reactor 20. Heated hydrogen is provided at 17, and is also introduced with the feedstock into reactor 20. The reactor 20 has an inlet flow distributor and catalyst support grid 21, so that the feed liquid and gas passing upwardly through the reactor 20 will expand the catalyst bed by at least about 10% and usually up to about 50% over its settled height, and place the catalyst in random motion in the liquid. This reactor is typical of that described in U.S. Pat. No. Re. 25,770, wherein a liquid phase reaction occurs in the presence of a reactant gas and a particulate catalyst such that the catalyst bed is expanded.

The catalyst particles in bed 22 usually have a relatively narrow size range for uniform bed expansion under controlled liquid and gas flow conditions. While the useful catalyst size range is between about 6 and 100 mesh (U.S. Sieve Series) with an upflow liquid velocity between about 1.5 and 15 cubic feet per minute per square foot of reactor cross section area, the catalyst size is preferably particles of 6 and 60 mesh size including extrudates of approximately 0.010–0.130 inch diameter. I also contemplate using a once-through type operation using fine sized catalyst in the 80–270 mesh size range (0.002–0.007 inch) added to the feed, and with a liquid space velocity in the order of 0.1–2.5 cubic feet of fresh feed per hour cubic feet of reactor volume cross-section area ($V_f/hr/V_r$). In the reactor, the density of the catalyst particles, the liquid upward flow rate, and the lifting effect of the upflowing hydrogen gas are important factors in the expansion and operation of the catalyst bed. By control of the catalyst particle size and density and the liquid and gas velocities and taking into account the viscosity of the liquid at the operating conditions, the catalyst bed 22 is expanded to have an upper level or interface in the liquid as indicated at **22*a***. The catalyst bed expansion should be at least about 10% and seldom more than 100% of the bed settled or static level.

The hydroconversion reaction in bed 22 is greatly facilitated by use of an effective catalyst. The catalysts useful in this invention are typical hydrogenation catalysts containing activation metals selected from the group consisting of cobalt, molybdenum, nickel and tungsten and mixtures thereof, deposited on a support material selected from the group of alumina, silica, and combinations thereof. If a fine-size catalyst is used, it can be effectively introduced to the reactor at connection 24 by being added to the feed in the desired concentration, as in a slurry. Catalyst may also be periodically added directly into the reactor 20 through suitable inlet connection means 25 at a rate between about 0.1 and 2.0 lbs catalyst/barrel feed, and used catalyst is withdrawn through suitable withdrawal means 26.

Recycle of reactor liquid from above the solids interface **22*a* to below the flow distributor grid 21 is usually needed to establish a sufficient upflow liquid velocity to maintain the catalyst in random motion in the liquid and to facilitate an effective reaction. Such liquid recycle is preferably accomplished by the use of a central downcomer conduit 18 which extends to a recycle pump 19 located below the flow distributor 21, to assure a positive and controlled upward movement of the liquid through the catalyst bed 22. The recycle of liquid through internal conduit 18** has some mechanical advantages and tends to reduce the external high pressure piping connections needed in a hydroconversion reactor, however, liquid recycle upwardly through the reactor can be established by a recycle conduit and pump located external to the reactor.

Operability of the ebullated catalyst bed reactor system to assure good contact and uniform (iso-thermal) temperature therein depends not only on the random motion of the relatively small catalyst in the liquid environment resulting from the buoyant effect of the upflowing liquid and gas, but also requires the proper reaction conditions. With improper reaction conditions insufficient hydroconversion is achieved, which results in a non-uniform distribution of liquid flow and operational upsets, usually resulting in excessive coke deposits on the catalyst. Different feedstocks are found to have more or less asphaltene precursors which tend to aggravate the operability of the reactor system including the recycle pumps and piping due to the plating out of tarry deposits. While these deposits can usually be washed off by lighter diluent materials, the catalyst in the reactor bed may become completely coked up and require premature shut down of the process unless undesired precipitation of such asphaltenes materials is avoided.

For the heavy petroleum residua feedstocks of this invention, i.e. those having asphaltenes at least about 2 W %, the operating conditions used in the reactor 20 are within the broad ranges of 750°-900° F. temperature, 1000-5000 psig, hydrogen partial pressure, and space velocity of 0.1-2.5 $V_f/hr/V_r$ (volume feed per hour per volume of reactor). Preferred conditions are 780°-850° F. temperature, 1200-2800 psig hydrogen partial pressure, and space velocity of 0.20-1.5 $V_f/hr/V_r$. Usually more preferred conditions are 800°-840° F. temperature and 1250-2500 psig hydrogen partial pressure. The feedstock hydroconversion achieved is at least about 75 V % for once-through single stage type operations.

In catalytic reactor 20, a vapor space 23 exists above the liquid level **23*a* and an overhead stream containing both liquid and gas fractions is withdrawn at 27, and passed to hot phase separator 28. The resulting gaseous portion 29, which is a mixture of hydrogen, light gases and vaporzied hydrocarbons, is cooled at heat exchanger 30 where the heavier hydrocarbon fractions are condensed and passed to gas/liquid phase separator 32. Such cooling is preferably done against a recycle gas stream 73 and is controlled by flow bypass valve 73*a*. At least a portion of the resulting condensed liquid 34 is used as an oil stream for quenching and quickly cooling the net reactor effluent liquid stream 40 from separator 28 to provide quenched stream 43, as described further hereinbelow. By controlling the temperature of the reactor effluent stream leaving exchanger 30, the composition of the quench oil stream 34** is also controlled, and the °API gravity of this quench oil stream is closely related to the composition of the quench stream.

From phase separator 32, gaseous fraction 31 is washed with water stream 33 to dissolve ammonium sulfide and ammonium chloride salts which otherwise would tend to precipitate as solids and clog flow passages in the heat exchangers, then further cooled in heat exchanger 35 and passed to phase separator 36. A portion of the resulting gaseous fraction is vented from the system at 37 and the remainder as medium-purity hydrogen stream 71 is recycled by compressor 70 along with high purity make-up hydrogen at 72 as needed, warmed at exchanger 30, reheated at heater 16, and is fed into the bottom of reactor 20. A water phase containing dissolved ammonium chloride is separated and removed from separator 36 as stream 74. The hydrocarbon liquid fraction 38 is passed to fractionator 50, along with a liquid fraction 52 from separator 32 which is also passed to fractionator 50.

From first phase separator 28, the liquid portion stream 40 is withdrawn, pressure-reduced at 41 to a pressure below about 1000 psig, and quenched to a temperature below about 775° F. and preferably to 700°-750° F., using liquid stream 42, and then passed as quenched stream 43 to separator 44. From separator 44, the resulting vapor fraction 45 is usually further cooled at exchanger 46 and then phase separated at separator 48 into vapor and liquid streams. The vapor stream 47 is usually passed, along with the vent stream 37 from separator 36, to a gas purification unit (not shown) for substantial recovery of the hydrogen gas. The resulting liquid at 49 can be passed to atmospheric pressure distillation at fractionator 50. Also from separator 44, liquid fraction 68 is also passed to fractionator 50.

As previously mentioned, the liquid stream from phase separator step 32 is withdrawn at 34, a portion used as quench oil is cooled at 51 and pressure-reduced at **42*a* to provide the quench liquid stream 42, while the remaining portion 52 is passed to fractionation step 50. From fractionator 50, a low pressure vapor stream 53 is withdrawn and is phase separated at 54 to provide low pressure gas 55 and liquid naphtha product stream 56 and to provide reflux liquid 57 to fractionator 50. Also, stripping stream 75 is introduced at near the bottom of fractionator 50. A middle boiling range distillate liquid product stream is withdrawn at 58, and a heavy hydrocarbon liquid stream is either withdrawn at 59 or passed as stream 59*a* through transfer pump 60 and heater 61 to a vacuum distillation step 62**.

From vacuum distillation step 62, a vacuum gas oil stream is withdrawn overheat at 63, and vacuum bottoms stream is withdrawn at 64. Preferably, a portion of the vacuum bottoms material usually boiling above about 875° F. is pressurized by pump 65 and recycled to reactor 20 for further hydroconversion, such as to achieve 80-98 V % conversion to lower boiling materials. A net vacuum bottoms product can be withdrawn at 66. The volume ratio of the recycled 875° F.+ material compared to the fresh feed should be within a range of about 0.2-1.5. A heavy vacuum pitch material is withdrawn at 64 for further processing as desired.

This invention is also useful for a two-stage catalytic conversion process for petroleum residua feedstocks, using two reactors connected in series flow arrangement. The effluent stream from the second stage reactor is phase separated and the resulting liquid fraction is flashed at lower pressure and then treated in accordance with this invention. If recycle of vacuum bottoms material is used for achieving increased hydroconversion, it is recycled to the first stage reactor.

This invention will be more fully described and better understood by reference to the following examples of actual hydroconversion operations, which should not be construed as limiting the scope of the invention.

EXAMPLE

As an example of the utility of the invention, a petroleum vacuum bottoms residuum stream normally boiling above 1000° F. and derived from a mixture of light and heavy Arabian crudes is catalytically hydroconverted. When operating the reactor in a high conversion mode by recycling unconverted 1000° F.+ material back to the reactor along with the fresh feed material such that 86 V % of the 1000° F.+ material present in the net fresh feed is converted to material having a boiling point lower than 1000° F., the reactor effluent liquid stream before quenching has a total API gravity of 21.5° and the process-derived quench oil stream has a total API gravity of 37.6° for a gravity difference of 16.1° API. For the same condition, the API gravity of the $C_5+$ material in the reactor effluent liquid stream before quenching is 9.7° and the API gravity of the $C_5+$ material in the process derived quench oil is 29.0° API for a gravity difference of 19.3° API. Under these conditions, no separate incompatible hydroconversion phase is formed and no operational difficulties occur in the process due to precipitation.

Although this invention has been described broadly and in terms of certain preferred embodiments, it will be understood that modifications and variations to the process can be made within the spirit and scope of the invention, which is defined by the following claims.

I claim:

1. A process for high conversion of petroleum residua containing at least about 25 V % material boiling above about 1000° F. to produce lower boiling hydrocarbon liquid products, comprising:

(a) feeding a petroleum residua feedstock together with hydrogen into a reaction zone containing an ebullated catalyst bed, maintaining said reaction zone at 750°–900° F. temperature, 1000–5000 psig hydrogen partial pressure for liquid phase reaction to produce a hydroconverted material containing a mixture of gas and liquid fractions, including $C_5+$ portions;

(b) separating said gas fraction from said liquid fractions in a first separation zone to provide a first gas fraction and a first liquid fraction, and cooling said first gas fraction to below about 650° F. to condense the gas and form a gas-liquid mixture;

(c) further separating said cooled gas fraction from said mixture in a second phase separation zone to provide a second gas fraction and a second liquid fraction and cooling said second liquid fraction to below about 650° F.;

(d) pressure-reducing said first liquid fraction to a pressure below about 1000 psig and flashing vapor from the liquid fraction while mixing the resulting liquid with at least a portion of said cooled second liquid fraction to quench the liquid to a temperature below about 775° F., said cooled second liquid fraction having an API gravity not more than about 22° API higher than the API gravity of said first liquid fraction; and (e) distilling said mixed liquid fractions to produce hydrocarbon distillate liquid products having normal boiling temperature below about 875° F. and a residual bottoms material.

2. The process of claim 1, wherein said second liquid fraction quenching liquid has an API gravity not more than about 17° API higher than the API gravity of said first liquid fraction.

3. The process of claim 1, wherein the API gravity of the $C_5+$ portion of said cooled liquid fraction has an API gravity not more than about 25° API higher than the API gravity of the $C_5+$ portion of the first liquid fraction being quenched.

4. The process of claim 1, wherein said first hydrocarbon gas fraction is cooled to 500°–650° F.

5. The process of claim 4, wherein said first gas fraction is cooled by a recycle hydrogen stream.

6. The process of claim 4, wherein the liquid residence time of said first separation zone is less than about 30 minutes.

7. The process of claim 1, wherein said first liquid fraction is cooled to 740°–770° F.

8. The process of claim 1, wherein a portion of said residual bottoms material boiling above about 875° F. is recycled to said reaction zone to increase the percent hydroconversion.

9. The process of claim 1, wherein the reaction zone temperature is 780°–850° F., hydrogen partial pressure is 1200–2800 psig, and space velocity is 0.2–1.5 volume net fresh feed per hour per volume of reactor.

10. The process of claim 1, wherein said hydroconverted material from said catalytic reaction zone is passed to a second stage catalytic reaction zone for achieving increased hydroconversion prior to the separation step.

11. The process of claim 10, wherein a residual bottoms material is produced and a portion of said residual bottoms material is recycled to the first stage catalytic reeaction zone for achieving increased percent hydroconversion.

12. A process for high conversion of petroleum residua containing at least about 25 V % material boiling above about 1000° F. to produce lower boiling hydrocarbon liquid products, comprising the steps of:

(a) feeding a petroleum residuum feedstock together with hydrogen into a reaction zone containing an ebullated catalyst bed, maintaining said reaction zone at 750°–900° F. temperature, 1000–5000 psig hydrogen partial pressure and 0.1–2.5 $V_f/hr/V_r$ liquid phase reaction to produce a hydroconverted material containing a mixture of gas and liquid fractions;

(b) separating said gas fraction from said liquid fraction in a first separation zone to provide a first gas fraction and a first liquid fraction, and cooling said first gas fraction to 500°–650° F. to condense the gas fraction and form a gas liquid mixture;

(c) further separating said cooled gas fraction from said mixture in a second phase separation zone to provide a second gas fraction and a second liquid fraction and cooling said second liquid fraction to below about 650° F.;

(d) pressure-reducing said first liquid fraction to a pressure below about 1000 psig and flashing vapor from the liquid fraction while mixing the resulting liquid with at least a portion of said second cooled liquid fraction to quench the liquid to a temperature about 740°–770° F., said cooled second liquid fraction having an API gravity not more than about 22° API higher than the API gravity of said first liquid fraction; and (e) distilling said mixed liquid fractions at successively lower pressures to produce hydrocarbon liquid products having a normal boiling temperature below about 875° F. and residual bottoms material, a portion of which is recycled to said reaction zone.

* * * * *